United States Patent [19]

Salazar

[11] Patent Number: 4,644,719

[45] Date of Patent: Feb. 24, 1987

[54] DECORATIVE WALL PANEL

[76] Inventor: Edward J. Salazar, 818 W. Kelly, Loveland, Colo. 80537

[21] Appl. No.: 712,747

[22] Filed: Mar. 18, 1985

Related U.S. Application Data

[63] Continuation-in-part of Ser. No. 503,024, Jun. 10, 1983, Pat. No. 4,590,726.

[51] Int. Cl.[4] ..... E04C 1/00; E04C 2/24

[52] U.S. Cl. ..... 52/311; 52/314; 52/746; 106/89

[58] Field of Search ..... 52/746, 311, 314, 315; 106/89

[56] References Cited

U.S. PATENT DOCUMENTS

| | | | |
|---|---|---|---|
| 3,496,694 | 2/1970 | Hicks et al. | 52/746 |
| 3,503,165 | 3/1970 | Hardt | 52/125 |
| 3,524,790 | 8/1970 | Mason | 52/314 X |
| 3,660,214 | 5/1972 | Nichols et al. | 52/314 X |
| 3,868,801 | 3/1975 | Weiner | 52/315 X |
| 4,590,726 | 5/1986 | Salazar | 52/314 |

FOREIGN PATENT DOCUMENTS

| | | | |
|---|---|---|---|
| 2261 | 1/1983 | Japan | 106/89 |

*Primary Examiner*—J. Karl Bell

*Attorney, Agent, or Firm*—Dean P. Edmundson

[57] ABSTRACT

A decorative wall panel is described which includes a reinforced base layer and a patterned top layer. The top layer comprises Portland cement, sand, and pigmented binder. The top layer is slow-cured and exhibits compressive strength of at least 1500 p.s.i. and high temperature color fastness. The top layer is firmly bonded to the base layer. The decorative panel can be made very thin and is self-supporting. It may be adhered to any desired wall substrate, for example, with adhesive, nails, screws, or other mechanical fasteners.

8 Claims, 5 Drawing Figures

DECORATIVE WALL PANEL

CROSS REFERENCE TO RELATED APPLICATION

This application is a continuation-in-part of my copending application Ser. No. 06/503,024, filed June 10, 1983 now U.S. Pat. No. 4,590,726.

FIELD OF THE INVENTION

This invention relates to decorative wall panels. More particularly, this invention relates to materials and techniques for making decorative wall panels which can be applied to a variety of wall structures.

BACKGROUND OF THE INVENTION

In the construction and finishing trades there have been many prior attempts to simulate a brick, stone or tile surface using materials less expensive than the genuine material. Some of these attempts involved cutting the genuine brick, stone, etc. into thin slabs which are then adhered to a conventional concrete wall, etc. for support. See, for example, U.S. Pat. Nos. 3,131,514; 1,669,351; 3,660,214; 3,740,910; 3,521,418; 3,775,916; 3,646,715; 2,122,696; 2,149,784; 2,339,489; 3,426,490; and 1,902,271. The expense, time, and care involved in cutting the brick or stone, etc. into desired thin slabs and then adhering them to the desired surface or substrate detract from the advantages of such techniques.

Another attempt to simulate a brick, stone, tile, etc. exterior involves pouring a mortar or concrete mix into a mold or form which includes the desired relief, e.g., brick, stone, etc. This technique is described, for example, in U.S. Pat. Nos. 3,002,322 and 3,874,140. Various limitations are inherent in this technique. For example, in order for the concrete or mortar mix to properly and completely fill the molds without leaving air pockets the mix must contain a considerable amount of water. This detracts from the strength of the cured mixture and increases the curing time. The finished product unfortunately still has the appearance of concrete and is all the same color, i.e., it does not have one color for the bricks or stone relief and a different color for the spacing between the brick or stone shapes. Moreover, it is difficult if not impossible to obtain sharp edges on the brick or stone shapes in these molds. As a result, the shapes are not as realistic as desired.

Another technique simply involved making panels or sections from plastic which has been molded to the desired relief. The panels or sections are then used as the outer decorative facing for the structure to be covered. See, for example, U.S. Pat. Nos. 3,882,218; 3,177,279; and 3,232,017. Of course, these products do not provide a totally realistic appearance and would not be adequate as a substitute for real brick, stone, tile, etc. in all situations.

Still another technique involved making simulated brick or tile elements out of plastic and then bonding them to a supporting panel or sheet with adhesive. See U.S. Pat. Nos. 3,991,529 and 4,079,554. Again, such a technique includes serious limitations.

Yet another technique involved forming two layers of magnesite applied to a metal lathe. The second layer is of a different color than the first layer. Before the second layer hardens, grooves are cut therethrough to form the shape of bricks, for example, and to reveal the underlying layer of magnesite. See U.S. Pat. No. 1,583,748.

Another cumbersome technique described in U.S. Pat. No. 3,426,490 involves forming individual brick veneer blocks made of concrete or fired clay which are adhered to a wire mesh in panel form. The panels are then secured to a wall with nails or staples. Mortar is then applied between the veneer blocks and forced into the wire mesh.

U.S. Pat. No. 3,496,694 describes yet another method in which molded formations made from cementitious plaster, plastic, or other suitable decorative material are adhered to a flexible base material. The prefabricated material may then be rolled up and transported to the job site where it is attached to the frame of a building.

U.S. Pat. No. 3,868,801 describes a building panel for a prefabricated house. The panel includes masonry elements (such as bricks), polyester mortar, wire mesh, polymer foam, and inner facing layers are held together by the mortar and foam.

U.S. Pat. 3,344,570 describes a reinforced flooring tile including a body of concrete with reinforcing framework embedded therein. The network is thermoplastic synthetic resin or metallic reinforcing.

U.S. Pat. No. 3,067,545 describes an artificial siding for frame buildings. A brick-like block is made of standard concrete block mixture which may include coloring pigments and water-proofing agents. The block is molded on metal mesh in such a manner that it extends through the mesh. The exterior surface of the walls of the building are covered with wooden sheathing and then felt paper. The brick/mesh pieces are then nailed to the wall individually as siding in such a manner that the mesh overlaps the mesh of the piece in the row below it. Presumably the spaces between adjacent bricks would have to be sealed in some manner.

U.S. Pat. No. 2,819,495 describes a method for making building blocks having a molded mortar surfacing simulating a plurality of bricks or stones. The mortar is first placed into a mold and must be tamped into compartments; then additional intermediate layers are added, after which concrete mix is added to form the main portion of the block. A disadvantage of this technique is that the facing is applied to the concrete block prior to the required conventional steam or oven curing of the block. Accordingly, additional care is required to handle such blocks prior to curing.

U.S. Pat. No. 2,748,443 describes a particular technique (involving a specially designed stencil) for applying a plastic mix, like mortar, to the face of a building in a predetermined pattern to simulate stone blocks. However, the wall to be faced is first covered with lathing over which is provided a continuous coating of plastic mix and then a brown coat. Then the mortar mix is applied with the aid of the stencil. This technique, of course, would not be practical for use with individual building blocks, nor is it a convenient technique even for large building faces.

U.S. Pat. No. 1,571,849 describes a multi-step method for making building blocks which is similar to that described in U.S. Pat. No. 2,819,495. A grate is placed on a flat plate and a concrete mix is then placed into the openings in the grate and must be tamped down until it is even with the top of the grate. The grate is then removed and the spaces between the shapes formed by the grate are filled with cementitious compost colored differently than the shapes left by the grate. Then another concrete mixture is added to form another layer.

The resulting structure is then removed from the mold on the flat plate and placed in the bottom of a mold of a cement block forming machine where the main portion of a cement block is formed on top.

U.S. Pat. No. 2,618,815 describes a rather involved and tedious method for applying a coating of plaster or cement to a wall to simulate the appearance of stone, cement blocks, or similar construction units. A plastic mold is filled with a concrete and mortar mix. The mold is then placed against a wall until the mortar mix adheres and sets (may be of the order of three hours). Alternatively, the mold may be coated with an adhesive coating such as a mixture of paraffin and kerosene. Marble dust, quartz particles or the like are then spread onto the coating, followed by ground stone particles. The mold is then filled with the mortar mix. Then the mortar mix may be pressed against the wall and the mold removed immediately, leaving the marble dust and paraffin-kerosene coating covering the mortar.

U.S. Pat. No. 2,130,911 describes a prefabricated building unit in which a first layer is applied directly onto a Celotex, fiber board, etc. The first layer may be plaster or cement (0.25 to 2 inches thick). Then facing elements made from natural stone, cement, wood, metal, linoleum or the like are pressed onto the surface of the first layer while either or both are in a plastic or semi-cured condition. Alternatively, the facing elements may be secured to the first layer by cement or adhesive. The facing elements may be pre-formed or may be formed from a plastic material on the base member in a continuous operation.

U.S. Pat. No. 3,304,673 describes a pre-cast panel which is adapted to be keyed to adjacent panels with specially formed inserts. The panel includes a base layer of cement and an embossed outer layer which simulates brick. Before the base layer is set the outer layer is added and then a mold is impressed against the surface of the outer layer to emboss it and provide a simulated brick facing. The outer layer may include pigments for coloring. Alternatively, the outer layer may be cast in a separate mold, hardened, and then laid in place over the first layer.

U.S. Pat. No. 3,503,165 describes a structural panel made of concrete. A simulated brick appearance may be achieved by putting a thin layer of wet concrete over the face of the panel and then pressing a mold downwardly into the wet concrete to imprint a brick appearance.

SUMMARY OF THE INVENTION

In accordance with the present invention there are provided simple, efficient, and effective techniques for forming a decorative wall panel which is adapted to be fastened to a wall substrate. The panel comprises:

(a) a continuous base layer comprising a reinforced cementitious material; and (b) a patterned layer bonded to the surface of the base layer.

The patterned layer comprises a slow-cured molded mixture of Portland cement, sand, and pigmented binder. The patterned layer exhibits high temperature color fastness. The patterned layer also bonds very firmly to the base layer.

The wall panels of the invention can be applied to various types of structures (for example, such as concrete walls, block walls, wood studs, metal studs, etc.). The panels are light-weight, durable, maintenance-free and may be constructed at low cost. The panels may be made in various desired sizes and are suitable for both interior and exterior applications. The panels may be constructed, transported, stored, and used as desired. The panel has the feel and appearance of conventional fired brick, for example, or it may have a glazed finish and appearance if desired.

BRIEF DESCRIPTION OF THE DRAWINGS

The invention is described in more detailed hereinafter with reference to the accompanying drawings wherein like reference characters refer to the same parts throughout the several views and in which.

DETAILED DESCRIPTION OF THE INVENTION

Figure 1:
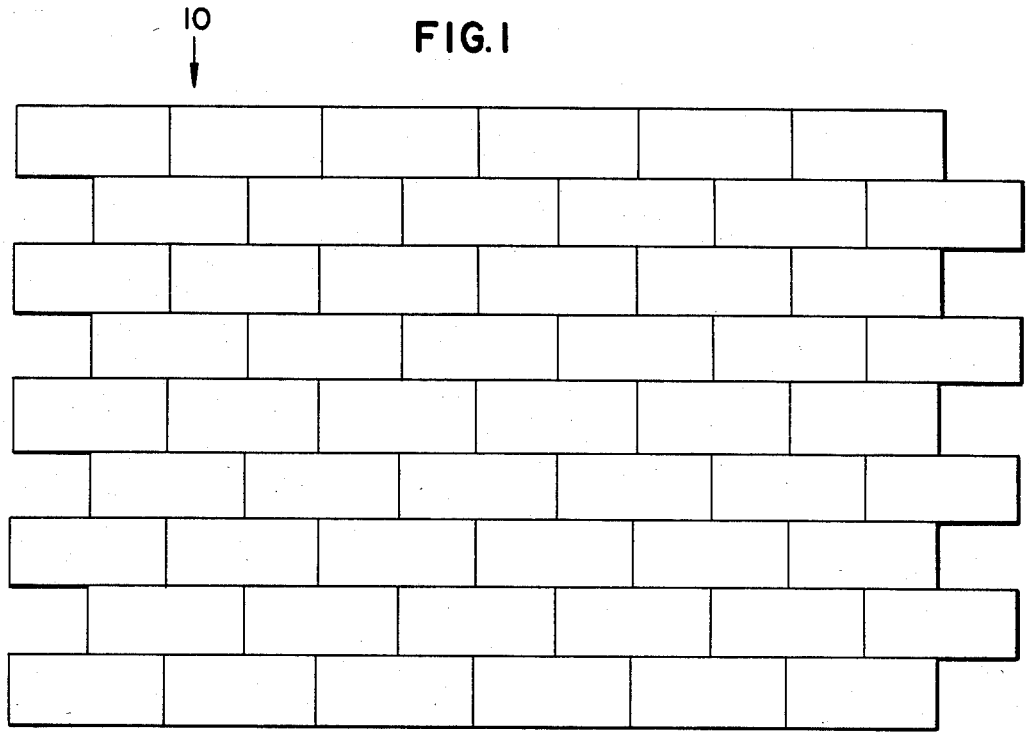
FIG. 1 is a side elevational view of one embodiment of a decorative wall panel of the invention.

Thus, in the drawings there is shown a decorative wall panel 10 made in accordance with this invention. The technique of the present invention, involving the application of a thin decorative, durable and inexpensive patterned facing on a continuous base layer which is reinforced, is a very economical way to obtain the advantages of a traditional brick appearance and durability while avoiding the high cost and weight of traditional brick, for example.

Opposite ends of wall panel 10 are made such that they are adapted to mate and interlock with the ends of similarly constructed panels. This may be achieved, for example, by means of alternate rows of simulated bricks projecting outwardly from the ends of the panel, as shown.

Figure 3:
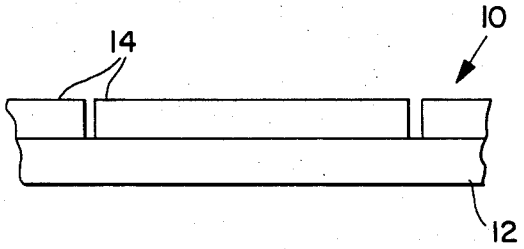
FIG. 3 is a cross-sectional view of the wall panel of FIG. 1.

In FIG. 3 there is shown a cross-sectional view of the wall panel of FIG. 1 showing a continuous base layer 12 and a patterned layer 14 bonded to the surface of the base layer. The base layer 12 comprises a reinforced cementitious material. The patterned layer comprises a slowcured molded mixture of Portland cement, sand and pigmented binder. The thickness of the base layer is typically in the range of about 0.1 to 2 inches (preferably 0.25 to 0.4 inch), and the thickness of the patterned layer is typically in the range of about 0.05 to 1 inch (preferably 0.1 to 0.25 inch). in the range of about 0.05 to 1 inch (preferably 0.1 to 0.25 inch).

The decorative panel may be made in various sizes. For example, they may be made as small as 16 by 24 inches or as large as 4 by 8 feet. A preferred size is normally about 16 by 48 inches for ease in manufacturing, handling and installation.

The panel size may vary, as desired. For example, for use in covering small interior walls the panels are conveniently 16 by 24 inches or 16 by 48 inches. For covering larger areas or exterior walls the panel size is preferably 4 by 8 feet or 2 by 8 feet for economy and ease of handling. The panels could, however, be made in any size.

The patterned layer may comprise a simulated brick appearance, as shown in the drawings, or it may simulate any other desired appearance. For example, it may simulate a stone appearance, if desired, or a glazed tile appearance, for example.

The continuous base layer is formed by placing the composition to be used in a mold under which is disposed a non-adhering material such as plastic, metal or other suitable material. The mold, for example, may be 88 inches long, 24 inches wide, and 0.25 inch deep in order to make a convenient size wall panel. The size and thickness of the panel may vary, as desired, depending upon the intended use and fire-resistance characteristics required in the panel.

The continuous base layer preferably comprises reinforced cementitious material. A preferred reinforcing material is fiberglass (for example, having a length of about one inch).

The amount of reinforcing fiberglass present may vary. Good results are obtained when it is 1–2% by volume of the base layer, but other amounts could be used.

Suitable commercially available reinforced cementitious compositions include "Q-Bond", commercially available from Q-Bond Co.; "Mine-Seal", commercially available from Mine-Seal Co.; and "Sure-Wall", commercially available from Sure-Wall Co.

After the base layer has been placed in the mold and troweled to a uniform thickness, the mold for the patterned layer may be placed over the continuous layer. The mold for the patterned layer may provide for any desired appearance, such as brick, stone, tile, etc.

Preferably the composition of the patterned layer is placed into the mold for the patterned layer before the base layer has cured. This results in a very firm bond of the patterned layer to the base layer. If the base layer is to be cured before the patterned layer is applied, then the base layer should have a rough texture or porous finish so that the patterned layer will adhere well when it is applied.

The mold used for the patterned layer preferably is as large as the panel being made (for example, 16 by 24 inches, 2 by 8 feet, 4 by 8 feet, 2 by 4 feet, etc.) so that only one mold is required for the patterned layer for each panel. The mold includes whatever pattern may be desired.

The depth or thickness of the mold may vary, depending upon the desired thickness, weight, fire-resistance, etc. of the completed panel. By making the panel thicker there is increased fire-resistance, for example. The thicker panels (e.g., one inch) may be attached directly to stud walls and therefore are desirable for this reason.

The base layer and the patterned layer are preferably cured at the same time at a temperature in the range of about 50° to 80° F., preferably 50° to 70° F., and out of direct sunlight, for at least 48 hours. The temperature during curing should be maintained within about a 20° F. range. To prevent the temperature from fluctuating beyond this amount it is possible to cover the panel with a plastic sheet or styrofoam insulation, or both, within 1–3 hours after forming the panel.

The base layer is exposed in the areas between the pattern of the top layer. Thus, the base layer is exposed in the joint areas and provides the color of the joints. Oxides or pigments may also be added to the composition of the base layer to provide the desired color for the joint areas.

The resulting cured patterned layer is very hard and has the appearance of conventional fired brick, for example, or glazed finish, or whatever other pattern is desired. The facing also exhibits high temperature color fastness (i.e., the facing can withstand a temperature of 1000° F. for at least one hour without deterioration or cracking of the facing and without undesirable fading of the color). The compressive strength characteristic of the facing material is at least 1500 p.s.i. (as measured on a 2 inch cube of cured material in accordance with standard testing as used by engineering laboratories to test mortar mix).

The manner in which the facing of this invention is cured is very important in terms of the compressive strength exhibited by the cured material and the color fastness thereof. It is has been found, unexpectedly, that if the wet composition used herein is permitted to cure too quickly both the compressive strength and color fastness are deleteriously affected (i.e., the color fades and the strength of the cured facing is less than desired).

Figure 2:
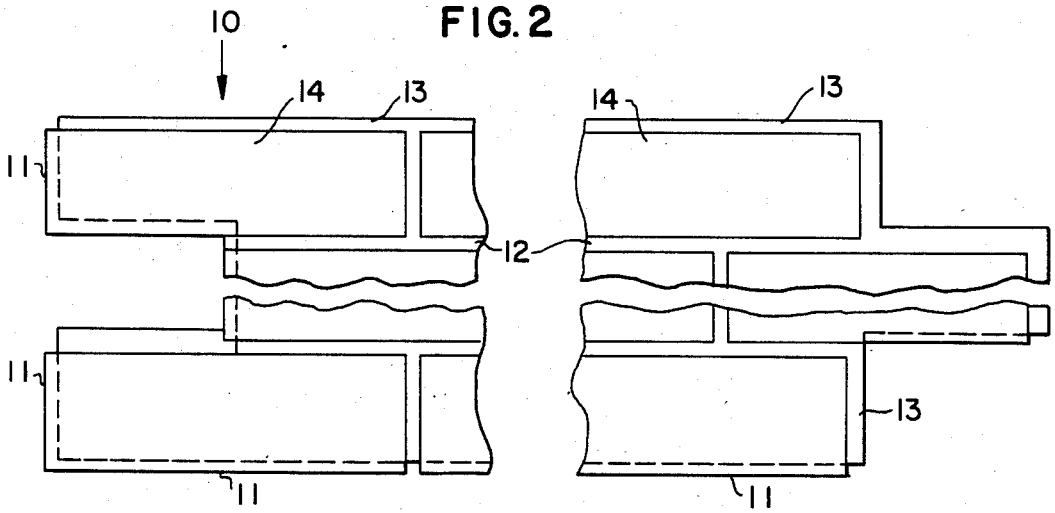
FIG. 2 is an elevational view of a portion of the wall panel of FIG. 1 shown in more detail.

In FIG. 2 there are shown the corner portions of the wall panel of FIG. 1 in more detail. Thus, there is illustrated that at one end and at the bottom edge of the distance of about 0.1 to 0.25 inch). At the opposite end and at the top edge of the panel 10 a portion 13 of the base layer 12 extends outwardly beyond the patterned layer 14 (e.g., a distance of about 0.1 to 0.25 inch). Then when one panel 10 is installed next to a similar panel, the portions of the patterned layer which extend beyond the base layer will overlap the exposed portions of the base layer on the adjacent panel. This helps to seal the assembled panels and avoids seams.

Figure 4:
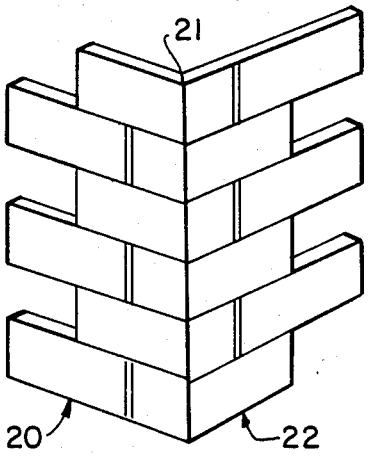
FIG. 4 is an isometric view of one type of corner panel section of the invention.

In FIG. 4 there is shown an isometric view of a corner panel section made in accordance with the techniques of the present invention. The panel section is adapted to form a right angle corner, as shown. Each side of the panel section has alternating patterned layers (e.g., brick pattern) which extend outwardly from the panel so that they will mate with alternating patterned layers of a wall panel of the invention.

The corner panel section may be an integral unit or, alternatively, it may be two sections which are adapted to fit together to form the corner. For example, the corner panel section may be made as an integral section and cut through the corner along line 21 to form separate sections 20 and 22. When the corner edges are abutted, as shown, a right angle corner is formed.

Figure 5:
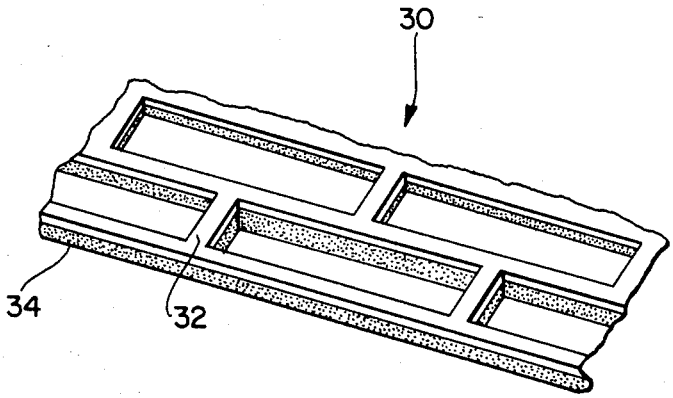
FIG. 5 is an isometric view of a preferred embodiment of mold used in the techniques of the present invention.

In FIG. 5 there is shown a preferred embodiment of mold 30 for use in forming the patterned layer. The mold comprises a self-supporting dimensionally stable frame 32 which may be made, for example, of durable plastic, metal, etc. On the underside of frame 32 there is attached a porous foam layer 34, as shown. The mold remains open in the areas of the desired pattern. The presence of the foam layer assures that the composition of the top layer (i.e., patterned layer) does not bleed beyond the desired area. Accordingly, the patterned areas remain distinct and sharply defined.

The patterned layer comprises a mixture of Portland cement, sand, and pigmented binder, preferably bentonite and concrete bonding adhesive. A preferred composition is as follows:

| | |
|---|---|
| Portland cement | 22% by volume |
| Sand (30–60 sieve size) | 15% by volume |
| Silica sand (30–60 mesh) | 30% by volume |
| Pigment | 30% by volume |
| Bentonite or sodium bentonite | 3% by volume |

To a mixture of these ingredients is added a mixture comprising of water and acrylic concrete bonding adhesive until the desired consistency is obtained. Preferably the batch size is no larger than the amount which can be used in one hour.

The pigment used in this invention is preferably a pigmented grouting commercially available from Custom Building Products. The grouting is available in a wide variety of colors and it contains Portland cement, pigment, water-retentive chemicals, and extenders. This material is particularly desired for use as a coloring pigment because the color of the resulting facing has very good aging characteristics and does not fade when the composition is cured in accordance with this invention. Additional conventional pigments may also be included, if desired.

The concrete bonding adhesive is presently preferred to be a modified acetate homopolymer emulsion commercially available from Dri-Mix. Other conventional concrete bonding adhesives may also be used, of course, if desired.

Because the face coating is to be in a particular shape or form, an appropriately shaped mold is first placed on the uncured base layer and then the facing composition is troweled into the mold and flush with the top thereof. If desired, additional pigments may be sprinkled dry onto the surface of the facing coating, then a sheet of plastic is placed on the surface and slight pressure applied (e.g., by hand or roller, etc.) to force the pigments into the coating, in order to achieve special coloring effects (e.g., the appearance of used brick).

A very attractive surface appearance may also be obtained by applying a liquid mixture of desired pigments to the surface of the facing material prior to removing the mold. It may be applied, for example, by spraying, sponging, brushing, rolling, etc. Special texturing of the surface may also be accomplished at this time, if desired.

Within one minute the facing coating usually will set sufficiently to be self-supporting depending upon the temperature and the thickness of the facing coating. The mold, which may be made of plastic, metal (e.g., steel, aluminum, etc.), is then removed and a fine water spray is applied.

After the top layer has been applied, as described above, the panel is air cured slowly, e.g., for about 18 to 24 hours. The panel is then preferably turned face down so as to eliminate warping. Total curing time out of direct sunlight is preferably 48 hours. The panel can be stored in this manner until needed.

A liquid mixture of one part pigment, one part adhesive, and one part water may be poured, sprayed, or rolled onto the surface to provide a multi-colored effect. A liquid mixture of one part pigment and one part adhesive may be poured onto the surface for a glazed finish appearance (which can be very desirable for walls in kitchens, restrooms, etc. which must be cleaned frequently).

The molds which may be used for the patterned layer can be made of various materials to which the composition of the base layer and the patterned layer will not adhere. A preferred material for the mold is a high density plastic. A convenient methods for making the mold is to cut it from a large sheet of plastic having the desired thickness (e.g., 0.1–1.0 inch). Preferably one such mold is used for the size of the entire panel being produced. That is, the mold is preferably as large as the panel to be made.

If desired, textures of various types may be imparted to the face of the patterned layer while it is still in the mold. For example, the material may be troweled to a smooth surface, it may be brushed, or it may be stamped with any desired configuration.

The patterned layer of the panels provided by this invention are characterized by high compressive strength (i.e., at least 1500 p.s.i. as measured on a two inch cube in accordance with standard engineering tests as used to test mortar mix, and preferably at least 2500–3500 p.s.i.). They are also characterized by exhibiting high temperature color fastness (i.e., the cured materials are capable of withstanding a temperature of 1000° F. for a period of at least one hour without deterioration, degradation, cracking, or color fading). These features are achieved by slow-curing the wet composition. The slow curing technique includes covering the composition with an airimpervious cover such as plastic sheeting, or insulation material such as styrofoam, etc. and maintaining the curing temperature in the range of preferably about 50°–70° F., preferably for at least 24 hours. If the temperature exceeds about 80° F. it is preferable to spray water on the exterior of the cover to cool the composition and slow the curing process. If the panel has been covered with insulation it will not be necessary to spray with water.

EXAMPLE 1

A material suitable for making the patterned layer on the panels of the invention is made using the following ingredients in the amounts stated:

| Ingredient | Parts by volume |
|---|---|
| Silica sand | 2 |
| Coarse sand | 1 |
| Portland cement | 1.5 |
| *Pigment | 2 |
| Water | 2–3 |
| Bentonite | 0.25 |
| **Concrete adhesive | 0.25–0.5 |

*The pigment is No. 70 Quarry Red pigmented grouting commercially available from Custom Building Products. It contains Portland cement, pigment, water-retentive chemicals, and extenders. Other conventional pigments may be included, if desired.

**The adhesive is a concrete bonding adhesive such as a modified acetate homopolymer emulsion commercially available from Dri-Mix. Other conventional concrete bonding adhesives may be used, if desired.

The sand, Portland cement, bentonite and pigments are first dry mixed. The water and adhesive are then added to the dry mix, followed by thorough mixing.

The resulting mass may be molded into various decorative facing forms, such as individual thin, rectangular shaped forms resembling brick facing, paving brick, quarry tile, glazed tile, etc. and slow-cured as described above, whereupon an extremely hard, durable facing material is obtained. Alternatiavely, the uncured mass may be coated or molded onto the surface of various substrates and then slow-cured to obtain a decorative facing, for example, resembling traditional fired brick.

A sample of the final mixture is molded into a cube having two inch sides and slow-cured at room temperature. After 24 hours the material exhibited good color and had a very hard surface and strong edges.

After seven days the cured material had a compressive strength of at least 2000 pounds per square inch; after 14 days it had a compressive strength of at least 3000 pounds per square inch. The cured material also exhibits high temperature color fastness.

In the practice of this invention it is highly preferable for the lower edge of the mold or frame to include a strip of porous material such as foam rubber bonded to such lower edge (as shown in FIG. 5). The porous material prevents the wet composition of the patterned facing material from migrating under the mold and thereby undesirably discoloring the surface between individual shapes of facing material which is being applied.

The decorative panels of the invention can be applied to various structures, such as concrete walls, block walls, wood studs, metal studs, etc. The panels may be fastened to such substrates with adhesive, screws, nails or other suitable fastening means. Preferably a panel adhesive is applied to the ends and edges of the panels when they are assembled to provide additional sealing of seams. The seams may also be caulked with sealant of the same color as the base material.

If desired, rigid styrofoam insulation may be applied over an existing wall, after which the decorative panel of the invention may be applied over the insulation. It is also possible to fasten rigid styrofoam insulation to wood or metal studs in new construction and then apply the decorative panels of the invention over such insulation.

Other variants are possible without departing from the scope of the present invention. For example, another variation is to form the panel on a thin layer (e.g., 1/16 to ⅛ inch thick) of cork. A sheet of cork which is the size of the desired panel is first coated with a mixture of one part water and one part concrete bonding adhesive, after which the base layer is applied as described above. The opposite surface of the cork may be provided with a pressure sensitive adhesive, for example, so that the finished panel may be simply adhered to the desired wall surface. This is a very advantageous technique for making small panels for do-it-yourself remodeling, etc. No nails, screws, or mechanical fasteners are required. Seams between panels may be easily caulked.

Other variations are also possible, for example, in the appearance of the joint areas between the patterned areas. One possible variation involves leaving the patterned mold in place until the patterned areas are cured until they are thumb-print hard. Then a mixture of paraffin was (one part) and kerosene (three parts) is applied over the entire panel (e.g., with a paint roller). Then the pattern mold is removed. After 12 to 36 hours a mixture of cement (1 part), coarse sand or silica (2 parts), sufficient water to make the mixture runny, and any desired pigments or oxides, is poured onto the panel and worked into the joint areas until they are filled flush with the top of the patterned layer. After this mixture has cured until it is thumb-print hard it may be worked to the desired finish (e.g., concave, convex, etc.). After the joint material has hardened for 24 to 36 hours the wax layer may be removed from the surface of the patterned layer by brushing with hot water. The presence of the wax layer protects the patterned areas when the joint composition is applied.

The decorative panels of the invention are strong and are fire-proof. Use of these panels avoids the need to affix a plurality of individual decorative elements to a wall substrate. Also, the panels can also be made very thin and therefore can be applied to existing walls without changing the trim, window moldings, etc. The panels may also be applied over styrofoam insulation which has been fastened to an existing wall, or to wood or metal studs in new construction.

What is claimed is:

1. A decorative wall panel adapted to be fastened to a wall substrate, said panel comprising:
   (a) a continuous base layer comprising a reinforced cementitious material; and
   (b) a patterned layer bonded to the surface of said base layer, wherein said patterned layer comprises a slow-cured molded mixture of Portland cement, sand, and pigmented binder;

wherein said patterned layer exhibits high temperature color fastness.

2. A decorative wall panel in accordance with claim 1, wherein said patterned layer simulates a repeating brick pattern.

3. A decorative wall panel in accordance with claim 1, wherein the ends of said panel are each adapted to mate with the ends of similar panels.

4. A decorative wall panel in accordance with claim 1, wherein said base layer has a thickness in the range of about 0.1 to 1 inch, and said patterned layer has a thickness in the range of about 0.1 to 1 inch.

5. A decorative wall panel in accordance with claim 1, wherein said base layer is reinforced with fibrous material.

6. A decorative wall panel in accordance with claim 5, wherein said fibrous material comprises fiberglass.

7. A decorative wall panel in accordance with claim 1, wherein said panel is adapted to be fastened to said wall substrate by means of adhesive.

8. A decorative wall panel in accordance with claim 1, wherein the surface of said base layer opposite said patterned layer is secured to a first side of a support substrate, wherein the second side of said support substrate is coated with an adhesive, whereby said decorative wall panel is adapted to be secured to a wall substrate by means of said adhesive.

* * * * *